US008182439B2

(12) United States Patent
Glenn

(10) Patent No.: US 8,182,439 B2
(45) Date of Patent: May 22, 2012

(54) INDIVIDUAL BODY SUPPORT SYSTEM

(75) Inventor: Michael C. Glenn, Clarksville, TN (US)

(73) Assignee: Emerald Touch, Inc., Fort Worth, TX (US)

( * ) Notice: Subject to any disclaimer, the term of this patent is extended or adjusted under 35 U.S.C. 154(b) by 201 days.

(21) Appl. No.: 12/522,094

(22) PCT Filed: Jan. 14, 2008

(86) PCT No.: PCT/US2008/050985

§ 371 (c)(1),
(2), (4) Date: Jul. 2, 2009

(87) PCT Pub. No.: WO2008/089128

PCT Pub. Date: Jul. 24, 2008

(65) Prior Publication Data

US 2010/0076359 A1 Mar. 25, 2010

Related U.S. Application Data

(60) Provisional application No. 60/884,850, filed on Jan. 12, 2007.

(51) Int. Cl.

| | |
|---|---|
| ***A61F 5/00*** | (2006.01) |
| ***A45F 3/04*** | (2006.01) |
| ***G10D 13/02*** | (2006.01) |

(52) U.S. Cl. ..... 602/19; 224/637; 84/421

(58) Field of Classification Search ..... 248/443; 84/421; 224/637, 627, 600, 191, 101, 266, 224/265, 910, 201; 602/35, 33, 32, 1, 5, 19, 20

See application file for complete search history.

(56) References Cited

U.S. PATENT DOCUMENTS

| | | | | |
|---|---|---|---|---|
| 3,355,075 | A * | 11/1967 | Dean | 224/262 |
| 4,303,186 | A | 12/1981 | Ollinger et al. | |
| 4,676,418 | A * | 6/1987 | Lowe | 224/638 |
| 5,184,763 | A | 2/1993 | Blaisdell et al. | |
| 5,954,253 | A * | 9/1999 | Swetish | 224/631 |
| 6,120,213 | A * | 9/2000 | Stinton | 405/186 |
| 2005/0082330 | A1 | 4/2005 | Fehlberg et al. | |

* cited by examiner

*Primary Examiner* — Patricia Bianco
*Assistant Examiner* — Tarla Patel
(74) *Attorney, Agent, or Firm* — Ross Spencer Garsson; Greenberg Traurig, LLP

(57) ABSTRACT

A body support system having a frame with a vertical section that couples with a shoulder section and a hip section that are flexible and configured to fit over the shoulders and around a user's hips. The hip elements are coupled to the vertical section and allow limited pelvic rotation around vertical axis orthogonal to the vertical section. The hip elements are configured to use a latching hip strap to couple hip padding to the hip elements. The vertical section may have spinal padding for the thoracic portion of the spine. The shoulder section has shoulder elements are curved and coupled to form a yoke that fits over the shoulders. The yoke may couple to lifting straps. The vertical section may be curved to conform to the shape of a user's back.

17 Claims, 14 Drawing Sheets

INDIVIDUAL BODY SUPPORT SYSTEM

RELATED APPLICATIONS

This application is claims priority to co-pending and commonly owned U.S. Provisional Application 60/884,850 filed Jan. 12, 2007. All the disclosure of U.S. Provisional Application 60/884,850 is incorporated by reference.

TECHNICAL FIELD

This invention relates support garments and in particular to body support systems that transfer back and spinal loading to the hips and legs of a user and may incorporate body armor or other load attaching features.

BACKGROUND AND SUMMARY

A body support system significantly enhances the survivability and physical endurance of a person, including military service members (which body support system may be a "body armor" support system). A body support system minimizes stress to frequently injured joints throughout the spine and shoulder girdle by redistributing the weight to the pelvic girdle. Wearers may find increased comfort and decreased fatigue whether walking or in a vehicle/aircraft.

The need for structural back supports to increase load bearing capability and prevent injuries has had attempts to address it from various points of view over years. The back injury is one of the highest rates of injuries known to industry. Currently our military and manufacturing industries suffers from increased costs and decreased available workers secondary to back injuries related to each of their industries. The loads applied to what are considered the most unstable joints in the body, the shoulders, cause an unnecessary strain and high rate of injury. The shoulder's instability is due to their ability for maximum range of motion. In order to achieve its range of motion the "shoulder girdle" does not develop with the advantage of the fusion used in the "pelvic girdle" to increase the stabilizing effects necessary for heavy repetitive load-bearing; strength is sacrificed for flexibility.

Common injuries to this area include nerve entrapments of the dorsal scapular nerve, spinal accessory nerve, axillary nerve, and thoracic outlet syndrome. Also rotator cuff injuries, acromioclavicular joint injuries, and capsular injuries are more frequent due to the repetitive motions necessary and constant-tension pressure compounded by the heavy load bearing. High impact injuries can cause compression fractures of the thoracic spine. Increased loads can cause compensation of the pelvis and increased lordosis of the lumbar spine. Research supports the idea that the spring loading affect on the lumbar spine directly increases the sheer forces of the fifth lumbar vertebra on the sacrum. (J Biomech. 1995 March;28(3):339-45; Eur Spine J. 2000 December;9(6):577-85)

For both military and civilians, load bearing on the shoulders or lifting which transfers weight through the spine increases the odds of injury through sheer number of exposures to the strain of the repetitive/constant loads. The lower extremities have to carry any weight which is born by the shoulders and spine so the ability to transfer any load directly to the waist (center of gravity and most stable structure) without the wear and tear on the spine increases the durability of the spine by decreasing the number of insults to it.

For the military, the equipment necessary to protect the soldier causes an increase load that works against the natural movement of the ribcage. The additional force is not natural and increases the rate of fatigue. This rate of fatigue is a result of increased "Work of Breathing", a term commonly used in intensive care units by healthcare personnel trying to maximize the recovery rate from injury, disease or surgery by minimizing the energy a patient expends elsewhere, such as breathing. In order to correct these issues and maximize biomechanical capabilities, the load needs to be carried by the most stable components and distributed in a way to keep increased loads from significantly affecting a person's natural center of gravity which is located just below the navel at the waist. Additional body surface area coverage may supplement bodily protection by adding Kevlar to the structure itself, thereby protecting exposed portions of the spine and waist.

Civilian applications require the same improvements to provide support, however, ballistic protection is not needed. Personnel in many industries involved in repetitive lifting would benefit from the ability to lift the loads with diminished stress on their spine and shoulders.

The repetitive movements with constant-tension pressures cause decreased passive circulation to tissues and joints. Research shows that decreased partial pressure of oxygen in tissues causes increased messenger RNA levels of alpha 1 pro-collagen (Falanga V, Martin T A, Low oxygen tension increases mRNA levels of alpha 1 (I) procollagen in human dermal fibroblasts. Journal of Cellular Physiology Vol. 157 Issue 2 pages 408-412, 1993). Decreased partial pressure of oxygen also leads to chemotaxis plus proliferation of fibroblasts (Dawes K E, Peacock A J, Characterization of fibroblast mitogens and chemo-attractants produced by endothelial cells exposed to hypoxia. American Journal of Respiratory Cell & Molecular Biology 10(5): 552-9, 1994 May). Fibrinogen, a sticky glue, is the result. With time, this forms adhesions causing restrictions in movement of affected joints.

The shock absorbing effect of the spinal disks is reduced by application of steady load pressures. This is analogous to a vehicle that has been laden with a load greater than it was designed for "bottoming out" when it hits a pothole.

The body support system as described herein can be used and modified for use in military and non-military applications. While the description below may at times focus upon certain military and non-military applications, these are done for exemplary purposes and for the purpose of teaching those skilled in the art the general manner of carrying out the invention.

In military applications, the placement of Kevlar along exposed surfaces not protected already by the body armor adds protective benefits. The non-body armor attachment allows the same benefit for use with frequently lifting heavy loads. Again minimizing stress to the most common joints injured in the labor force. Current heavy body armor systems weigh 20 to 40 pounds with combat loads increasing the total load to in excess of 100 pounds.

The majority of this weight is carried on the military member's shoulders and torso and transferred down through the wearer's spine. The present invention allows the direct transfer of the heavy body armor system's weight directly to the pelvic girdle minimizing stress to the spinal and shoulder joints. An embodiment of the invention may include a nylon webbing waist belt secured with quick clips; hip, lumbar, and spinal padding with additional Kevlar fabric in areas not protected by the existing body armor systems; semi-rigid composite hip components and spinal component with adjustable yoke to redistribute the weight off the shoulders; a shock absorbing/flexible viscous-elastic polymer connection for the spinal and hip components. An embodiment may employ a ratchet-like adjustable swiveling support to redistribute the front load off the anterior chest wall shifting it to the hips; a vest-like shock absorbing liner with airflow channels to minimize heat retention. Other embodiments may employ a shock absorbing vest with airflow channels would realize an improvement in heat exchange thereby maximizing personnel heating/cooling.

A semi-rigid spinal segment with articulating hip components made of Kevlar® like reinforced composites up to ballistic standards may be used for the hip components and lower portion of the spine component. A mechanism is provided that allows axial adjustment of spinal component to insure proper fit of support to the individual body armor allowing up to approximately 6 inches of correction. Also provided are attachable and replaceable pads for the hips, lumbar support and yoke of the spine. Hip mounted (bilaterally) ratcheting or strut-like support may be used support the weight of the front load. These supports may be secured in front by nylon straps with "quick clips" attached to the composite components.

An embodiment for civilian applications may have differences from an embodiment for military applications as follows: Kevlar is added primarily for structural integrity. Hip mounted struts/ratchets are secured to the spine segment for stabilization. The yoke of the civilian version projects over the shoulders enough to allow for lifting straps to descend from the ends of the yoke such that they may be attached to any item being lifted without cutting into the clavicle. Additional straps may descend to attach to the front of the hip components to diminish anterior-posterior movement of the spine/lifting component.

Civilian versions may be made available direct to factories as well as for sale through popular construction supply outlets or warehouses. Also, backpack versions and versions that allow mothers to carry a baby and supplies with less back strain may be marketed.

Military versions, used to protect crewmembers and occupants of aircraft and ground vehicles (hereinafter referred to as vehicle occupants) from high velocity projectiles such as shrapnel or bullets, have traditionally required expensive upgrades. Vehicle occupants are extremely vulnerable from small arms, anti-aircraft fire or landmines. Since armor is relatively heavy, armoring large sections of aircraft becomes weight prohibitive. Ground vehicle occupants in trucks, jeeps, or cars may be in similar situations and may therefore benefit from approaches used for personnel in aircraft.

Heavy protection vests are feasible for vehicle occupants since they are normally seated and engage in limited activity. The problems faced by vehicle occupants with the heavy body armor occur because of extended wear or travel over rough terrain. The body armor's additional weight bears down on the wearer's spine, causes rubbing on the wearer's back and chest, and if worn loosely, can impact on the wearer's upper thighs. During severe bumps, hard landings, or traveling over rough terrain, the increased body armor weight could contribute to serious spine injuries.

An embodiments of the present invention lifts the weight off the shoulder girdle and distributes it to the pelvic girdle, in addition, it facilitates a more accurate biomechanical pelvic movement.

The structural design allows the use of optional attachments to the system (yoke/waist). The potential versions include:

- mailbags (saddlebags)
- baby carrier (papoose on front for small children and on back for large children
- backpack (small for children and school/large for long camping trips)
- medical lifting straps to aid in lifting patients by nurses, emergency
- medical service technicians, and other staff who frequently lift patients
- lifting straps with attachments for use in factory/mechanical other work which requires lifting (straps can be standardized with the ability to customize attachments for specific jobs)
- lifting straps which allow attachments for personal use in domestic duties requiring devices that include, for example: weed-eaters, yard blowers, etc.
- Fireman: structure to carry oxygen tanks
- Policemen: structure to carry/distribute weight of heavy shields, soft body armor, and equipment used frequently when breaching or searching a hazardous/dangerous environment.

A body support system comprises a vertical section extending in a vertical axis between first and second ends. A shoulder section is configured as a yoke with two shoulder elements each configured to ride above and off the shoulders of a user. The shoulder section is adjustably positioned along the vertical axis to conform to a size of the user and rigidly coupled the vertical section proximate to the first end. A hip section with hip elements is coupled at the second end. The hip elements are configured to flex to conform to hips of the user. The hip section is rigidly coupled along the vertical axis of the vertical section and flexibly coupled in directions allowing the user a range of motions relative to the vertical axis when secured in the body support system. An adjustable latching strap is configured to couple to connectors on the hip section and secure the hip elements around hips of a user when tightened.

The body support system may have hip padding configured as a lumbar pad coupled between first and second hip pads, wherein the hip padding is configured to couple to the hip section. The body support system may further comprise spinal padding coupled to the vertical section and configured as thoracic pad. The system may include shoulder pads coupled to the shoulder elements of the shoulder section.

The body support system may be configured such that each end of the shoulder elements has a connector for attaching lifting straps that aid a user in lifting a load when secured in the body support system.

The body support system has features that allows body armor in the form of a vest that is fitted over the body support system when worn by a user such that the weight of the body armor is directed by the vertical section and onto the hips and legs of the user.

The latching strap may be used to couples the hip padding to the hip section and secures the lumbar pad against a lumbar of the user and the hip elements, padded with the first and second hip pads, against hips of the user.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
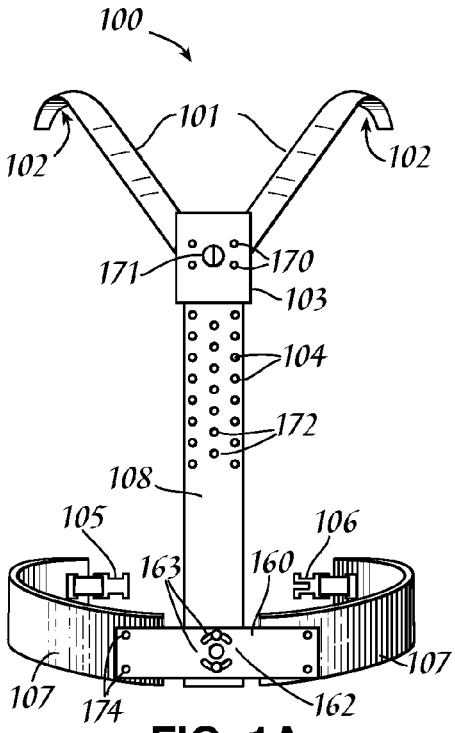
FIG. 1A is a back view of the frame according to an embodiment.

The frame shown in the drawings may be fabricated out of a composite material (such as made of fiber glass, carbon fibers or combinations thereof) and/or other suitable material. The padding and an optional cushioned vest may be fabricated out of a gel and/or an air gel or other suitable material that would provide desired protection. For instance, the padding may be fabricated by layering two or more layers to arrive at a suitable composite. In an embodiment, the cushioned vest may be made of Kemmler's SHOCKtec® gel and the padding may be fabricated out of layers of the previously described gel, Kemmler's Air2Gel® gel, and other suitable material layers.

All U.S. patents, U.S. patent applications, and other materials (e.g., articles) referred to herein are incorporated herein by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent and the text and drawings made herein control.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

In following, a user is a person that makes use of the body support system to aid in lifting or carrying of loads. In describing embodiments, the spine is considered the "vertical" axis and as such may vary in its alignment as a user's moves. Certain elements are described as having a geometric relationship relative to this vertical axis, for example orthogonal to the vertical axis. As the user moves with the body support relationships between elements may change relative to their relationships when the use is standing erect.

Refer to the drawings for a detailed description of the body support system according to disclosed embodiments.

FIG. 1A is a back view of a body support system 100 according to an embodiment. A vertical section 108 is adjustably coupled a shoulder section or yoke has shoulder elements 101 joined at a base, like base 103. Base 103 has features (for example four pins) that are configured to mate with corresponding location holes 104 in vertical section 108. Base 103 also has a locking feature, for example, a screw 171 that is configured to engage one of a set of threaded screw holes 172. In this manner, base 103 and thus the yoke or shoulder section may be moved in increments corresponding to the spacing between a row of the location holes 104. An exemplary screw 171 is then tightened to hold the yoke or shoulder section in engagement with the vertical section 108. The hip section comprises two flexible hip elements 107 configured to conform to a user's hips when mating latch elements 105 and 106 are engaged. Hip elements 107 are likewise rigidly coupled to base section 160 with fasteners 174 to make up the complete hip section. The hip section is coupled with a pivot 162 to vertical section 108. Base section 160 also has opposing curved slots that extend in arcs about pivot 162. Vertical section 108 has corresponding pins that acts as stops so that the hip section will have limited rotation about an axis orthogonal to the vertical axis of the vertical section 108. In this embodiment, when the body support system 100 is fixed to a user, the user has some freedom to rotate their hips relative to vertical section 108.

Figure 1C:
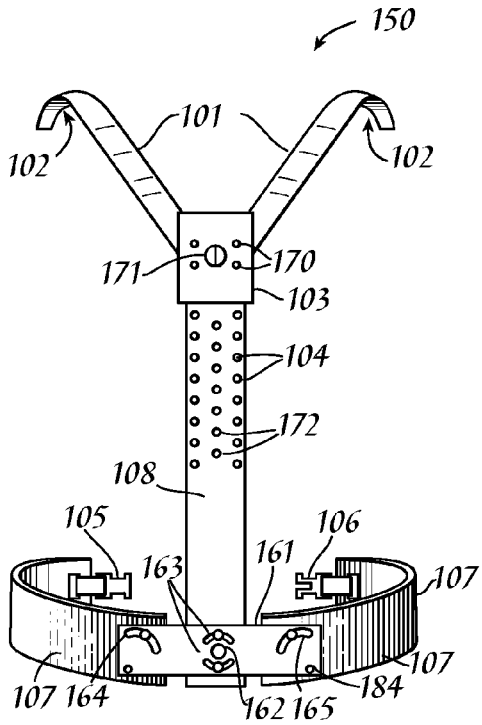
FIG. 1C is a back view of the frame according to another embodiment.
Figure 1B:
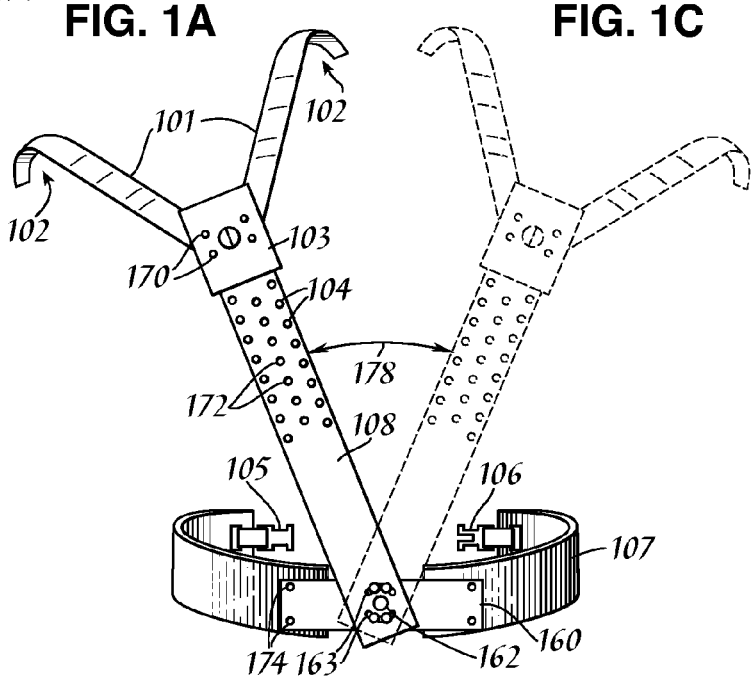
FIG. 1B is a back view of the embodiment of FIG. 12A illustrating side to side movement of the vertical section pivoting on the hip section.

FIG. 1B is another view of the body support system 100. A vertical section 108 is adjustably coupled a shoulder section or yoke having shoulder elements 101 joined at a base 103. Base 103 has features (for example four pins 170) that are configured to mate with corresponding location holes 104 in vertical section 108. Base 103 also has a locking feature, for example, a screw 171 that is configured to engage one of a set of threaded screw holes 172. In this manner, base 103 and thus the yoke or shoulder section may be moved in increments corresponding to the spacing between a row of the location holes 104 to adjust to a user's size. Exemplary screw 171 is then tightened to hold the yoke or shoulder section in engagement with the vertical section 108. The hip section comprises two flexible hip elements 107 configured to conform to a user's hips when mating latch elements 105 and 106 are engaged and a corresponding hip section strap is tightened. Hip elements 107 are likewise rigidly fastened to base section 160 with fasteners 174 to make up the complete hip section. The hip section is coupled with a pivot 162 to vertical section 108. Base section 160 also has opposing curved slots that extend in arcs about pivot 162. Vertical section 108 has corresponding pins that acts as stops so that the hip section will have limited rotation about an axis orthogonal to the vertical axis of vertical section 108. In this embodiment, when the body support system is fixed to a user, the user has some freedom to rotate their hips relative to vertical section 108. This view shows the vertical section 108 pivoting an angle 178. This would occur when a user pivoted at the waist while keeping their hips fixed relative to a horizontal line.

FIG. 1C is back view of a body support system 150 according to an embodiment. A vertical section 108 is adjustably coupled a shoulder section or yoke have shoulder elements 101 joined at a base 103. Base 103 has features (for example four pins 170) that are configured to mate with corresponding location holes 104 in vertical section 108. Base 103 also has a locking feature, for example an exemplary screw 171 that is configured to engage one of a set of threaded screw holes 172. In this manner, base 103 and thus the yoke or shoulder section may be moved increments corresponding to the spacing between a row of the location holes 104 to adjust to a user's size. Exemplary screw 171 is then tightened to hold the yoke or shoulder section in engagement with the vertical section 108. The hip section comprises two flexible hip elements 107 configured to conform to a user's hips when mating latch elements 105 and 106 are engaged and a corresponding hip section strap is tightened. Hip elements 107 are likewise fastened to base 161 with pivoting fasteners 184 to make up the complete hip section. The hip section is coupled with a pivot 162 to vertical section 108. Base section 161 also has opposing curved slots that extend in arcs about pivot 162. Additionally, base section 161 has two complementary opposing slots 164 and 165. Vertical section 108 has corresponding pins that act as stops in slots 162-165 so that the hip section will have limited combined rotation about an axis orthogonal to vertical section 108 and limited independent rotation relative to base section 161. In this embodiment, when the body support system is fixed to a user, the user has some freedom to rotate their hips relative to vertical section 108 with more degrees of freedom than for body support system 100.

Figure 1D:
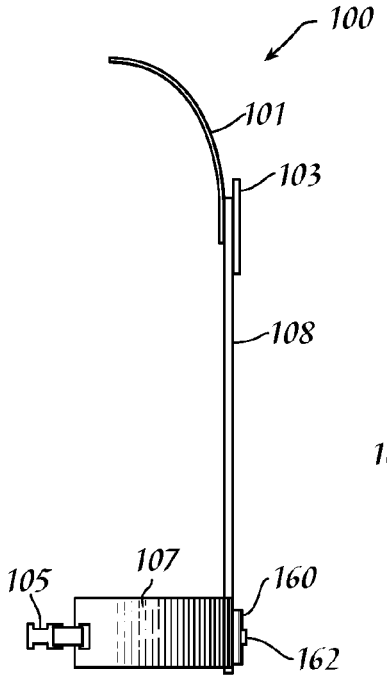
FIG. 1D is a side view of the frame showing the hip section and the curvature of the shoulder section configured to ride above and off the shoulders of a user.

FIG. 1D is a side view of a body support system 100 according to an embodiment. Vertical section 108 is coupled to a shoulder section comprising shoulder elements 102 coupled with a base 103. Vertical section 108 is likewise coupled by base 161 to a hip section comprising two hip elements 107. A portion of a hip strap 105 for securing the body support system to as user is likewise shown.

Figure 1F:
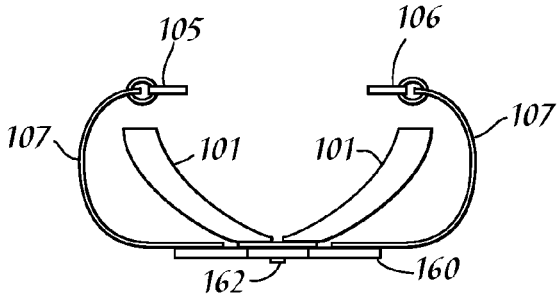
FIG. 1F is a top view of the frame of FIG. 18A showing the hip section and the curvature of the shoulder section.
Figure 1E:
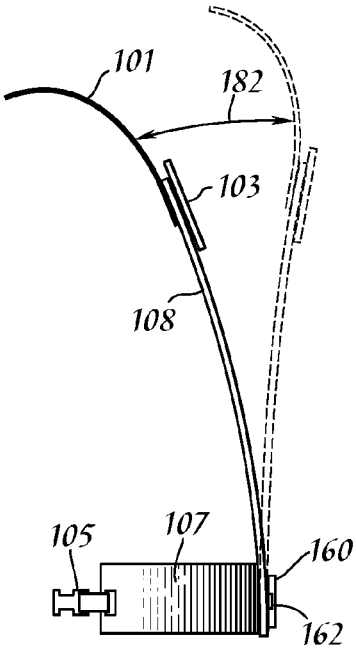
FIG. 1E is a side view of the frame showing the hip section and the curvature of the shoulder section showing back to front flexibility the vertical section according to an embodiment.

FIG. 1E is another side view of body support system 100 of FIG. 1D. Vertical section 108 is coupled to a yoke or shoulder section comprising shoulder elements 101 coupled with a base 103. Vertical section 108 is likewise coupled by base section 160 to a hip section comprising two hip elements 107 using a fastener 162. A portion of a hip strap 105 for securing the body support system to as user is likewise shown. This view shows bending of vertical section 108 through an angle 182 relative to base section 160 which corresponds to motion of a user when bending at the hips while in the body support system 100.

FIG. 1F is a top view of the body support system 100 showing the hip section with hip elements 107 coupled to base section 160. The hip section is likewise coupled to vertical section 108 (not clearly visible in this view) with fastener 162. The shoulder elements 101 are also shown in this view.

Figure 1G:
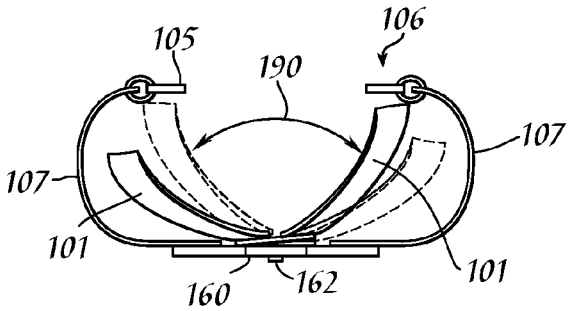
FIG. 1G is a top view of the frame of FIG. 18A showing the hip section and pivoting of the shoulder section about the vertical axis of the vertical section.

FIG. 1G is a top view of the body support system 100 showing the hip section with hip elements 107 coupled to base section 160. The hip section is likewise coupled to vertical section 108 (not clearly visible in this view) with fastener 162. The shoulder elements 101 are also shown in this view. Fastener 162 is configured to allow the yoke or shoulder section comprising shoulder elements 101 to rotate relative to the vertical axis of vertical section 108. This embodiment allows a user to twist their shoulders relative to their hips when secured in body support system 100.

Figure 2:
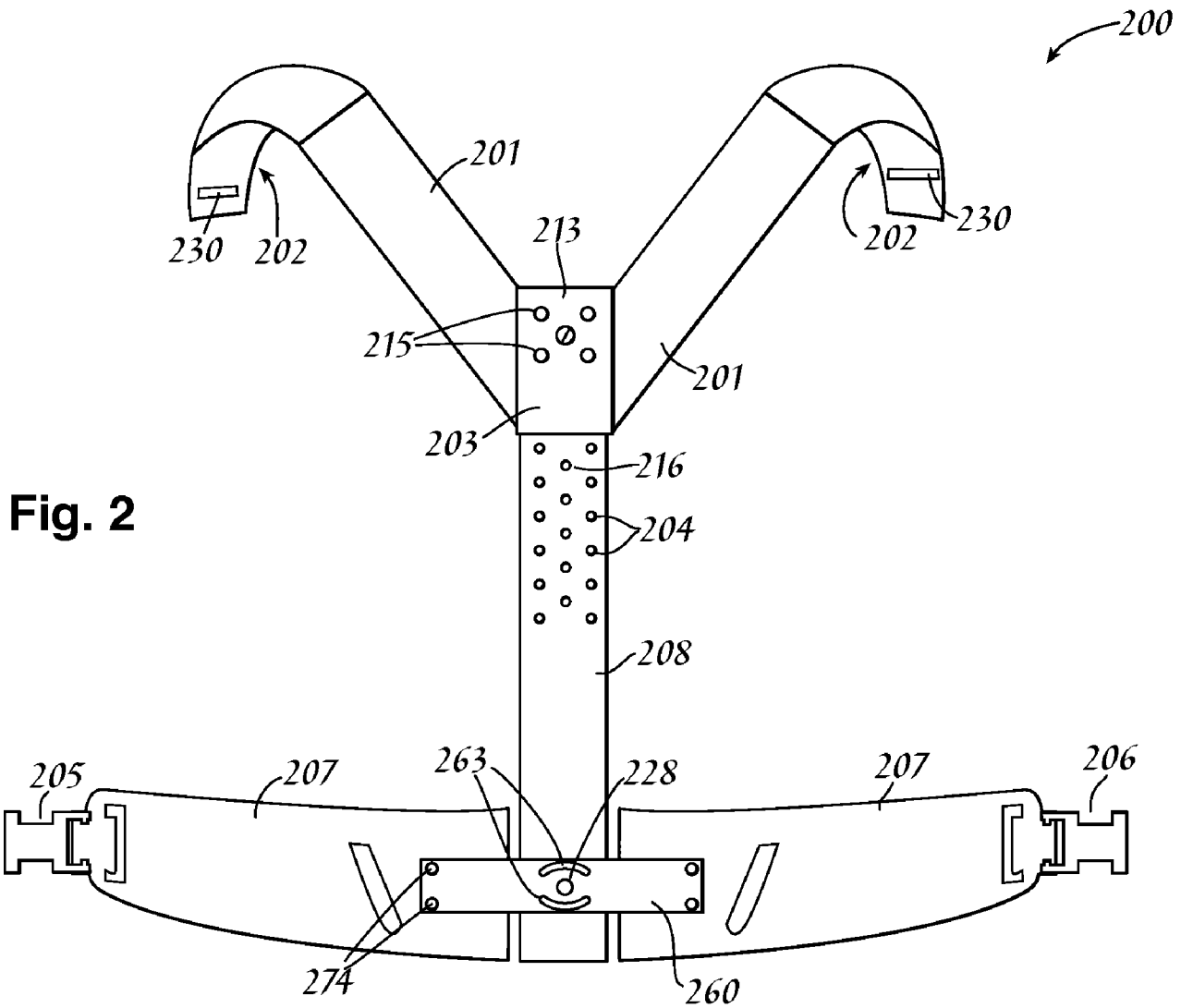
FIG. 2 is a back view of a frame showing vertical section and the shoulder and hip sections according to an embodiment.

FIG. 2 is a back view of a body support system 200 according to an embodiment. Frame 200 has three sections; a vertical section 208, a shoulder section and a hip section. Vertical section 208 is shown as a rectangular element that extends along the vertical axis of the spine. The shoulder section comprises an adjustable "yoke" made up of two shoulder elements 201 that have curved sections 201 that enable the shoulder section or yoke to ride above and over a user's shoulders. The two shoulder elements 201 are joined at a base 203 that has features that allow it to be adjustably positioned along vertical section 208. For example, base 203 may have pins 215 that fit in the holes 204 shown along vertical section 208. A locking element (e.g., a screw 213) may be use hold base 203 engaged to the vertical section 208. Exemplary threaded mating screw holes 216 may be then selectively placed along vertical section 208 to facilitate adjusting the distance between the shoulder section and the hip section to accommodate the size of a particular user. The hip section comprises two flexible hip elements 207 that are sufficiently flexible to allow them to bend around the hips of a user. The two hip elements 207 are coupled with a base section 260 to vertical section 208 with a pivot 228 that allows the hip elements 207 to jointly pivot on vertical section 208. Base section 260 also has opposing slots 263 that limit the amount rotation about pivot 228. Vertical section 208 has pins (not visible) that engage the slots 263 to limit rotation. This particular embodiment limits the amount that the hip elements 207 may jointly pivot on vertical element 208. The hip section and the shoulder section (yoke) are coupled with vertical section 208 such that they are rigid in the vertical axis along the spine when worn by a user. However, the coupling in other directions (e.g., pivot feature of base section 260) allows the user a range of motions such as bending or twisting of the back. Vertical section 208 may be constructed to have bending and twisting flexibility while maintaining a stiffness against vertical extension or compression. Connectors 205 and 206 may be part of straps used in conjunction with padding (not shown) and are suitable for connecting to an elastic or adjustable strap for securing the hip elements 207 when bent around to conform to a user's hips. Mating features 230 shown as slots are for coupling load lifting straps to the shoulder elements 201. Load lifting straps (not shown) may be threaded through the slots 230 and secured with a buckle, snap or Velcro®.

Figure 3:
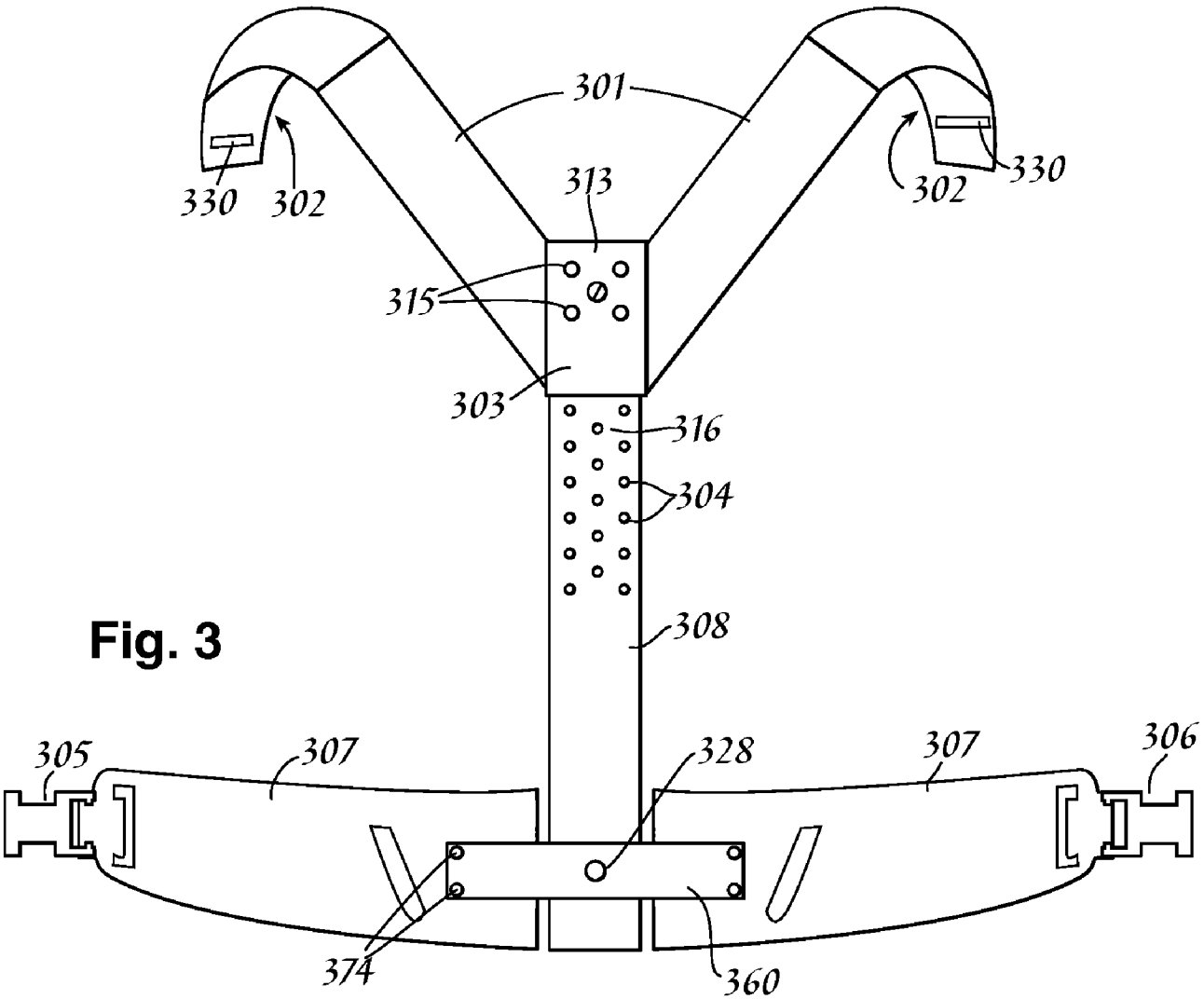
FIG. 3 is a back view of a frame showing vertical section and the shoulder and hip sections according to another embodiment.

FIG. 3 is a back view of a body support system 300 according to another embodiment. Frame 300 has three sections; a vertical section 308, a shoulder section and a hip section. Vertical section 308 is shown as a rectangular element that extends along the vertical axis of the spine. The shoulder section comprises an adjustable "yoke" made up of two shoulder elements 301 that have curved sections 301 that enable the frame 300 to "hang" over a user's shoulders. The two shoulder elements 301 are joined at a base 303 that has features that allow it to be adjustably positioned along vertical section 308. For example, base 303 may have pins 315 that fit in the holes 304 shown along vertical section 308. A locking element (e.g., a screw 313) may be use hold base 303 engaged to the vertical section 308. Mating screw holes 316 may be then selectively placed along vertical section 308 to facilitate adjusting the distance between the shoulder section and the hip section to accommodate the size of a particular user. The hip section comprises two flexible hip elements 307 that are sufficiently flexible to allow them to bend around the hips of a user. The two hip elements 307 are coupled with a base section 328 to vertical section 308 with a feature that allows the hip elements 307 to jointly pivot on vertical section 308. This particular embodiment has no limits to the amount that the hip elements 307 may jointly pivot on vertical element 308. The hip section and the shoulder section (yoke) are coupled with vertical section 308 such that they are rigid in the vertical axis along the spine when worn by a user. However, the coupling in other directions (e.g., pivoting feature of base section 328) allows the user a range of motions such as bending or twisting of the back. Vertical section 308 may constructed to have bending and twisting flexibility while maintaining a stiffness against vertical extension or compression. Connectors 305 and 306 may be part of straps used in conjunction with padding (not shown) and are suitable for connecting to an elastic or adjustable strap for securing the hip elements when bent around a user's hips. Mating features 330 shown as slots are for coupling load lifting straps to the shoulder elements 301. Load lifting straps (not shown) may be threaded through the slots 330 and secured with a buckle, snap or Velcro®.

Figure 4:
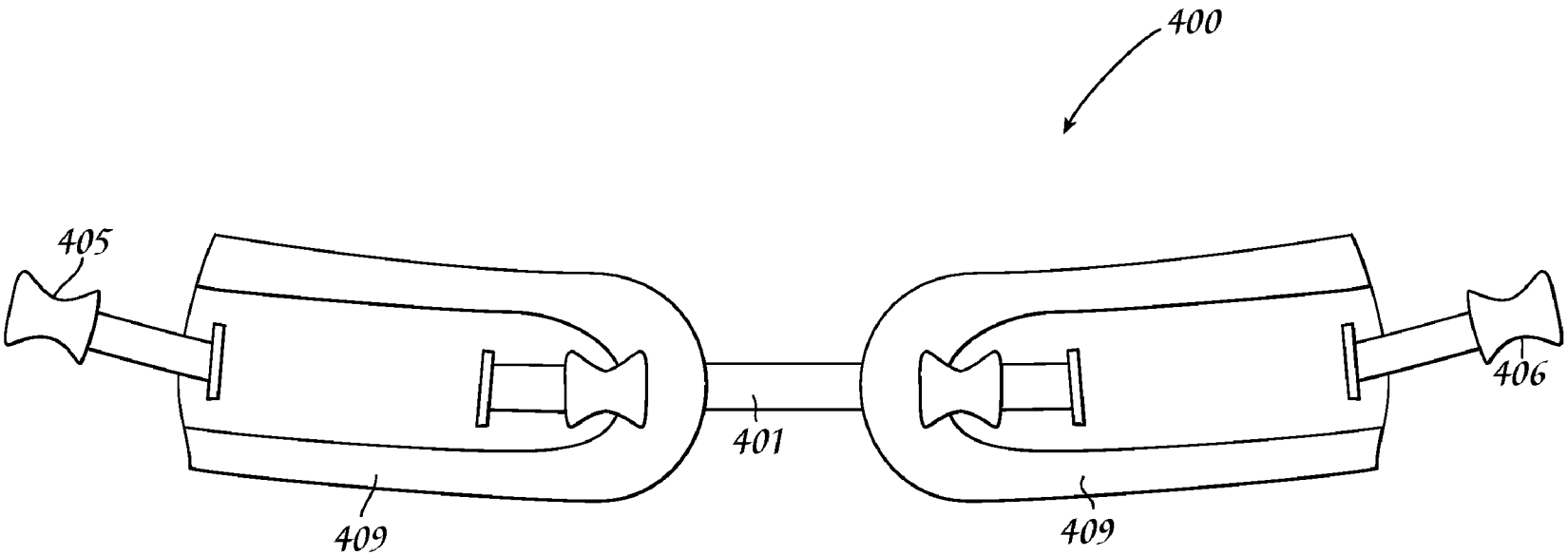
FIG. 4 illustrates an adjustable strap threaded through hip pads.

FIG. 4 illustrates hip padding 400 suitable for use with the frames 200 and 300 from FIGS. 2 and 3, respectively. Strap 401 threads through hip pads 409 and corresponding hip elements of a frame (e.g. frame 200 or 300 in FIGS. 2 and 3) used in the body support system according to disclosed embodiments. Connectors 405 and 406 are used together with a suitable strap with mating connectors to secure the hip padding 400 when coupled to a frame (e.g., 200) of a body support system.

Figure 5:
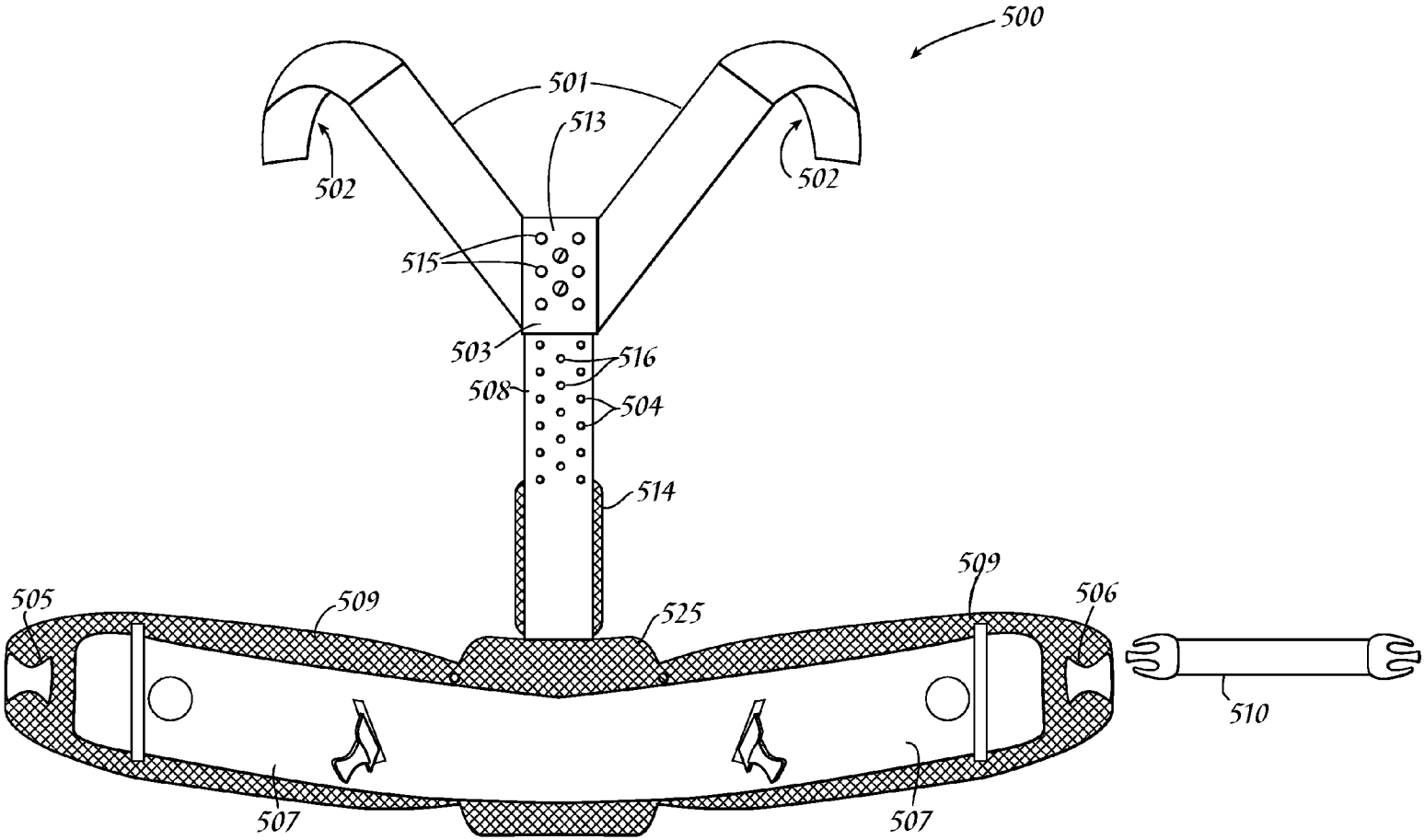
FIG. 5 is a back view of a body support system with hip padding and optional spinal padding.

FIG. 5 is a back view of a body support system according to an embodiment. Because this is a back view only portions of some elements (e.g., padding) may be visible. The body support system 500 includes a frame with a vertical section 508 coupling to a hip section and a shoulder section. Only the hip elements 509 of the hip section are visible in this view, however, the hip section is coupled to the vertical section 508 in a manner illustrated in other figures (e.g., FIGS. 2 and 3). Hip padding includes hip pads 509 and lumbar pad 525 and is coupled to the hip elements 507 with a strap (not visible). Strap 510 is employed to secure the hip section around the hips of a user. The body support system 500 also includes an optional spinal pad 514 in the thoracic area. Vertical section 508 is adjustably connected to the shoulder section or yoke that has shoulder elements 501 with curved areas 502 for fitting over a user's shoulder. Base 503 couples the shoulder elements 501 together and has features for adjustably positioning the shoulder section along vertical section 508. Vertical section 508 has mating features that engage to the features so the body support system may be adjusted for various sized users. An exemplary system uses multiple pins 515 in base 503 that mate with corresponding holes 504 in vertical section 508. Exemplary screw(s) 513 with mating screw holes 516 or other suitable locking mechanism may be used to hold base 503 in contact with vertical section 508. Other types of fasteners and mating features may be use to adjust and secure the position of the shoulder section along vertical section 508 and still be considered within the scope of the present invention.

Figure 6:
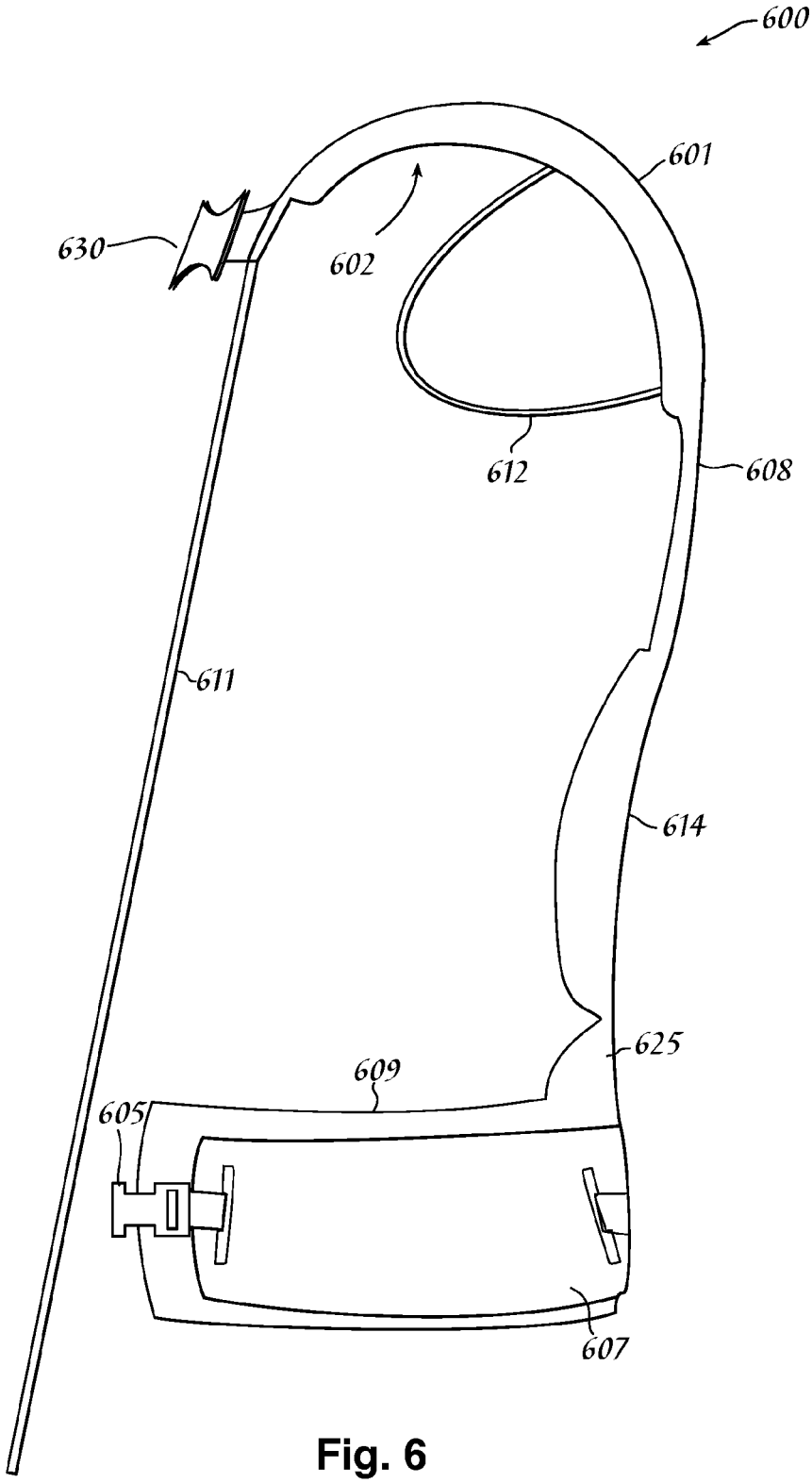
FIG. 6 illustrates a body support system with a load lift strap according to an embodiment.

FIG. 6 is a side view of a commercial a body support system 600 according to an embodiment. Hip element 607 is shown in a position corresponding to when secured around the hips of a user with a strap (e.g., 510 of FIG. 5) not visible in this view. A hip pad 609 is also shown in this view along with portions of a lumbar pad 625 and a thoracic spinal pad 614. The vertical section 608 is shown curved in one plane to conform to a spinal contour of a typical user. A shoulder member 601 of the shoulder section or yoke has curved area 602 for fitting over a user's shoulder. In this embodiment, one of two load lifting straps 611 is shown coupled to a mating feature 630 on one of the shoulder members 601 of the yoke or shoulder section. The mating feature 630 may be a slot in the end of the shoulder elements that allows the end of the load lifting straps to be threaded through and secured using exemplary buckles, snaps, or Velcro®. An optional shoulder stabilizer strap 612 is also shown. When a user lifts a load with the body support system 600, the loading operates to compress the yoke or shoulder section downward. This downward compression is transferred through the vertical section 608 to the hip section and thus the hip elements 607 and the hips of the user. This load transfer greatly reduces the compressive stress from the spine and shoulders of the user when lifting a load using the body support system 600.

Figure 7:
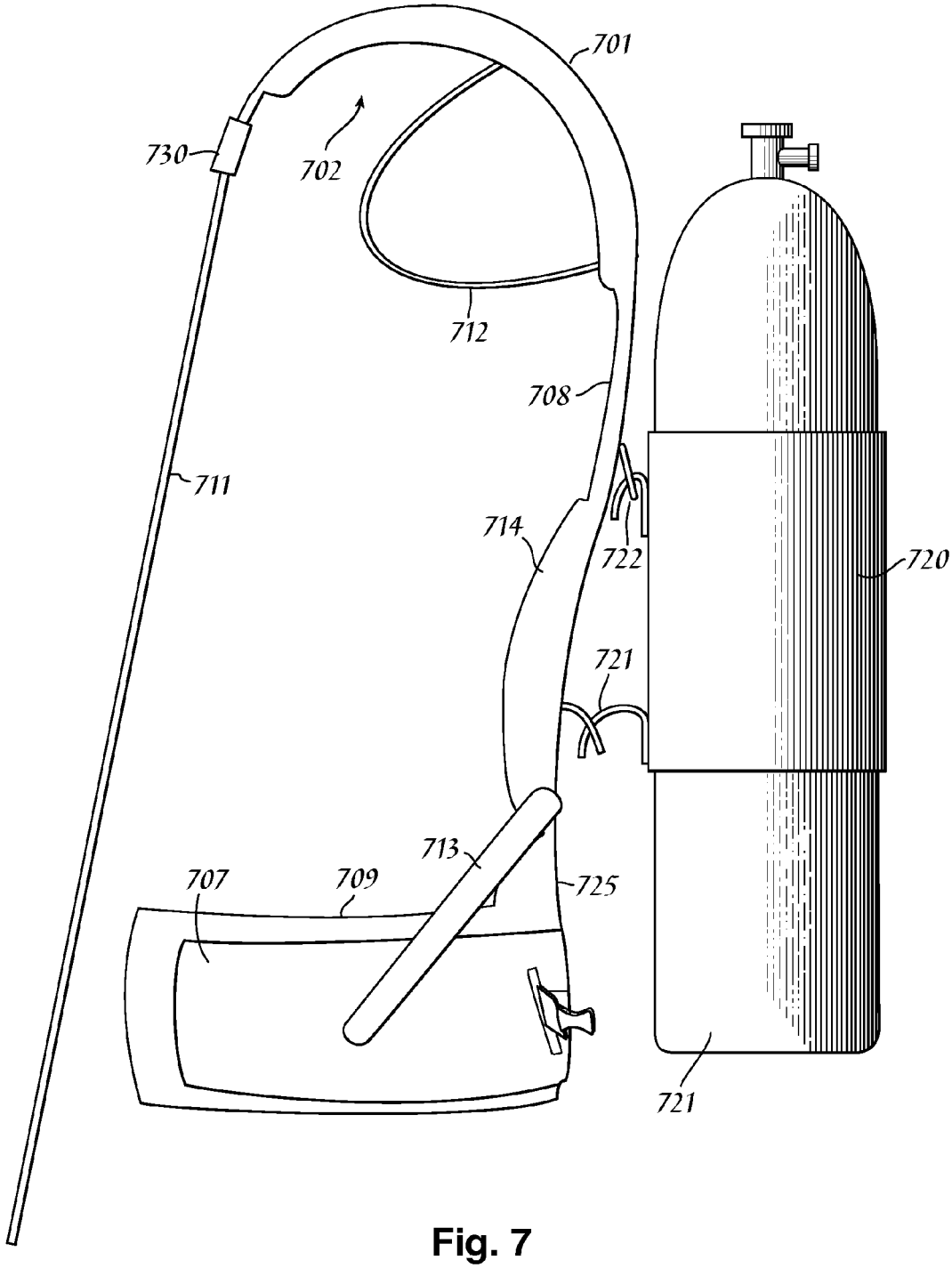
FIG. 7 illustrates a body support system with a load lift strap and a back load coupled to the vertical section according to an embodiment.

FIG. 7 is a side view of a commercial a body support system 700 that has been adapted to carry a back load shown as a tank in this embodiment. Hip element 707 is shown in a position corresponding to when secured around the hips of a user with a strap (e.g., 510) not visible in this view. A hip pad 709 is also shown in this view along with portions of a lumbar pad 725 and a thoracic spinal pad 714. The vertical section 708 is shown curved in one plane to conform to a typical user spinal contour. Vertical section 708 has also been adapted with couplings 721 and 722 configured to engage a carrying adapter 720 fitted to tank 721. The back load of tank 721 is thereby directed by vertical section 708 to the hip elements 707 and thus to the hips of a user. A shoulder member 701 of the shoulder section (yoke) has curved area 702 for fitting over a user's shoulder. In this embodiment, one of two load lifting straps 711 is shown coupled to a mating feature 730 on one of the shoulder members 701 of the yoke or shoulder section. The mating feature 630 may be a slot in the end of the shoulder elements that allows the end of the load lifting straps to be threaded through and secured using exemplary buckles, snaps, or Velcro®. An optional shoulder stabilizer strap 712 is also shown. When a user lifts a load with the body support system 700, the loading operates to compress the yoke or shoulder section downward. This downward compression is transferred through the vertical section 708 to the hip section and thus the hip elements 707 and the hips of the user. This load transfer greatly reduces the compressive stress from the spine and shoulders of the user when lifting a load using the body support system 700. In some embodiments the load lifting straps 711 may be replaced by straps that couple from the shoulder elements 701 to the front of the hip elements 707 to give the body support system improved stability and load distribution.

Figure 8:
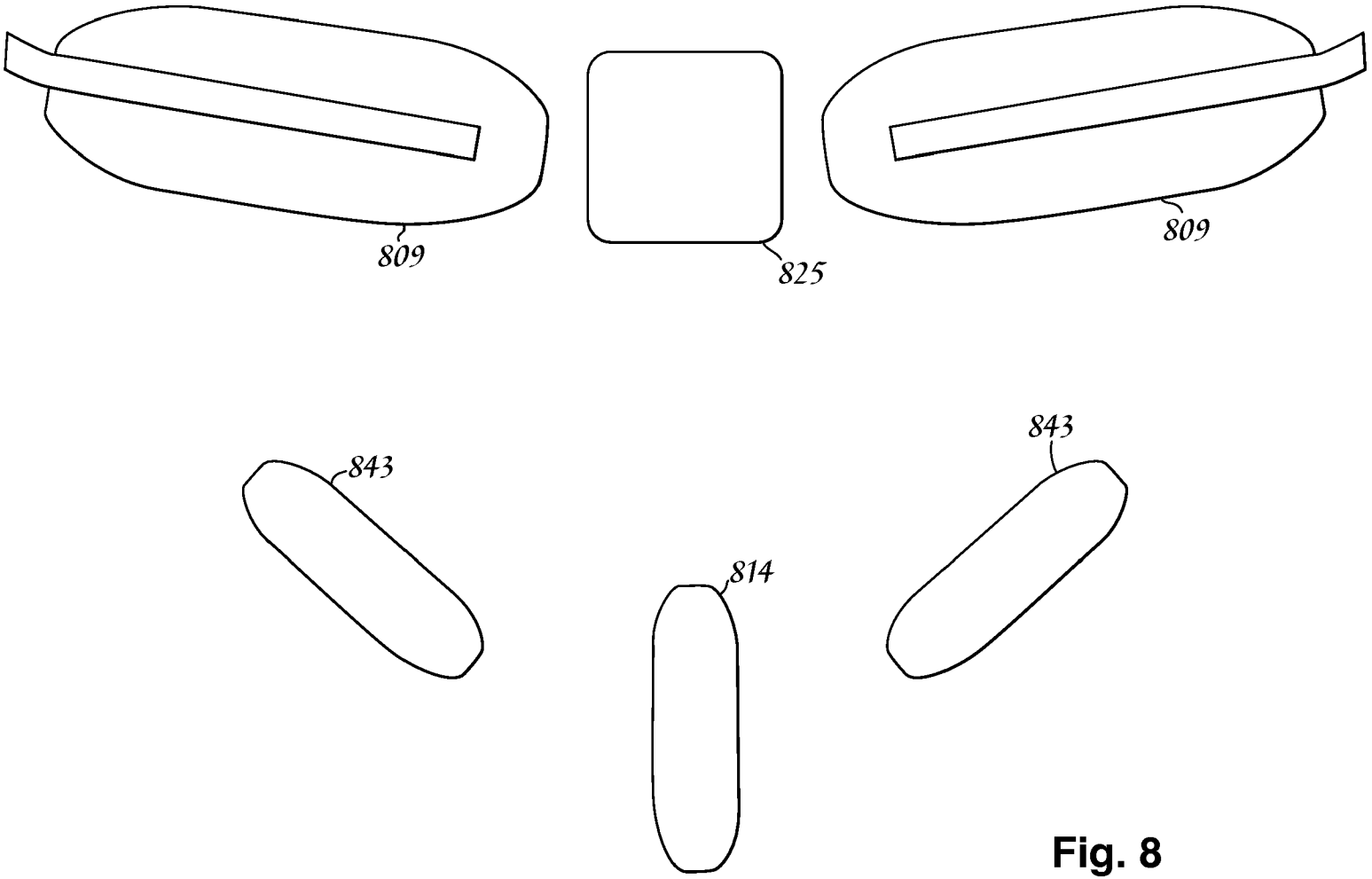
FIG. 8 illustrates hip padding and shoulder and spine padding suitable for use with embodiments herein.

FIG. 8 illustrates various padding that may be suitable for use with various embodiments of the body support systems disclosed herein. Hip pads 809 would be coupled to corresponding hip elements (e.g., 707 in FIG. 7). Spinal pads include a lumbar pad 825 and a thoracic pad 814. Also shown are optional shoulder pads 843 used with exemplary shoulder elements (e.g., 701 in FIG. 7).

Figure 9:
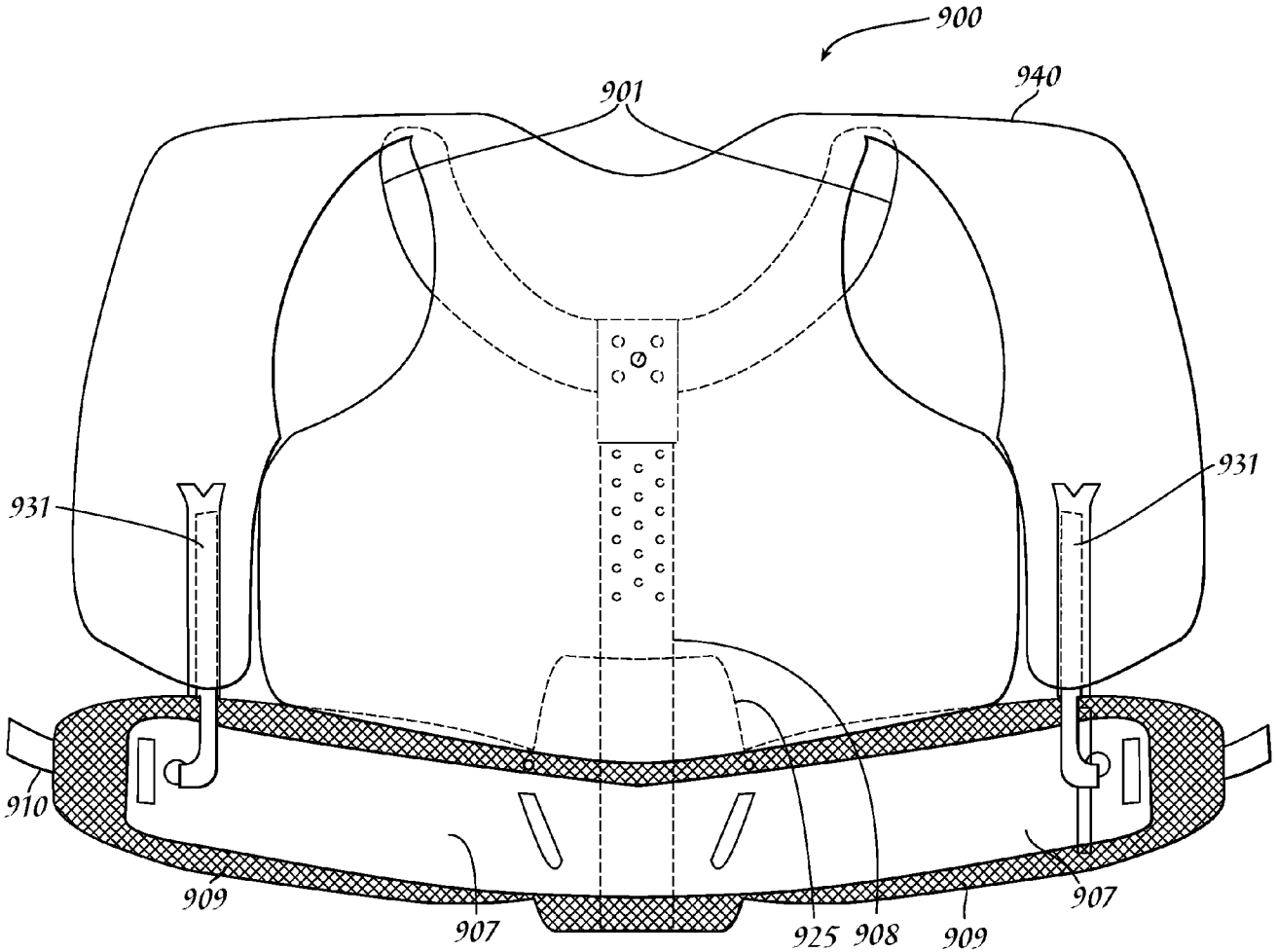
FIG. 9 illustrates a body support system with overlaying body armor according to an embodiment with the hip section strap unlatched.

FIG. 9 is a back view of the body support system 900 according to an embodiment with overlaying body armor 940. The two shoulder elements 901 are joined with base 903 to form a shoulder section or yoke according to an embodiment. The yoke or shoulder section is adjustably attached to vertical section 908 to allow the body support system to accommodate users of different height. Overlaying body armor 940 is shown in an open position corresponding to an unlatched hip section. The hip section includes hip elements 907 coupled to hip pads 909 and lumbar pad 905. The ends of hip section strap 910 is also shown. Optional supports 931 are also shown in this view.

Figure 10:
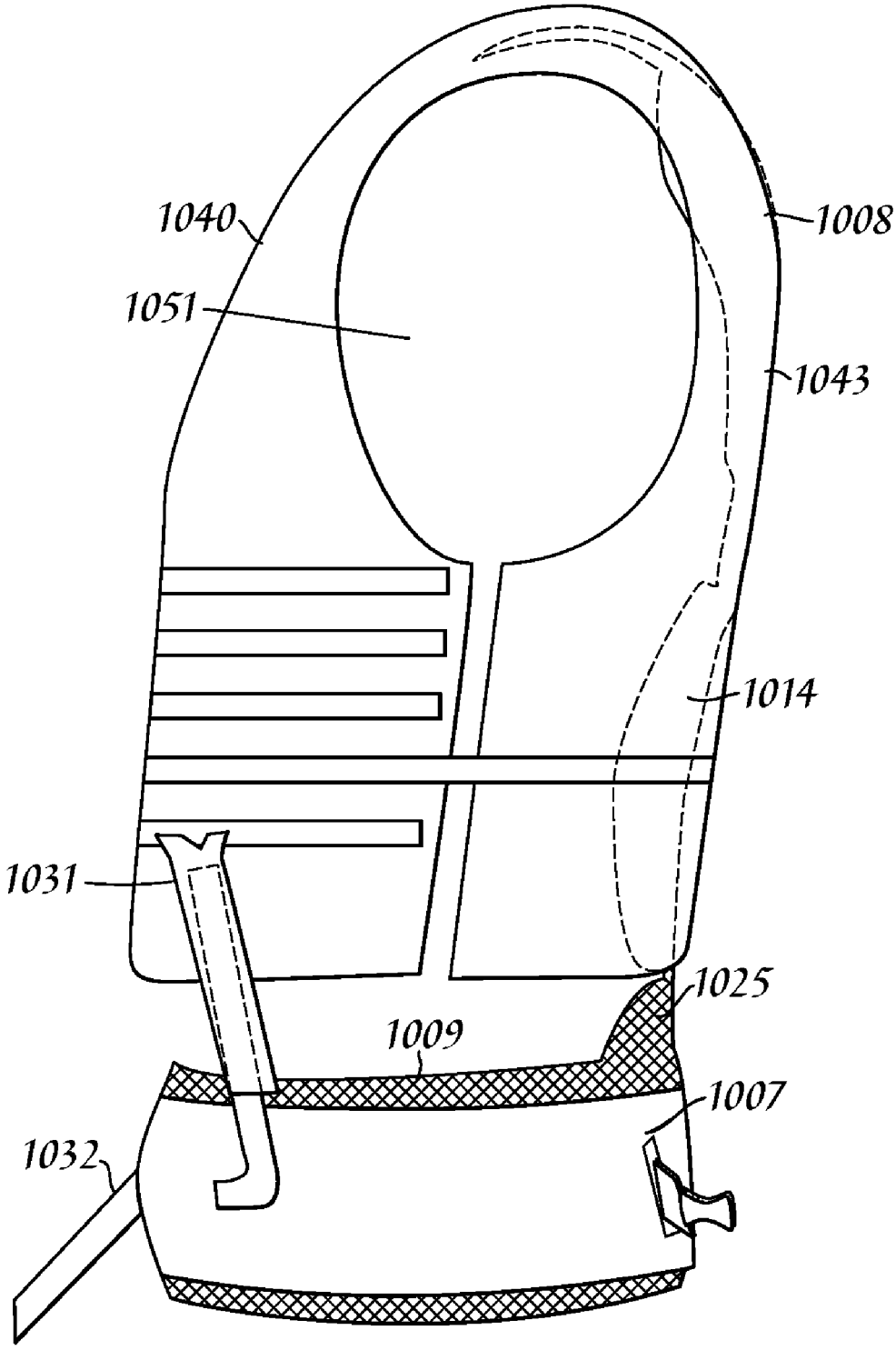
FIG. 10 is a side view of a body support system with overlaying body armor according to an embodiment.

FIG. 10 is a side view of a body support system 1000 with overlaying body armor 1040. Vertical section 1008 is coupled to the hip section having hip elements 1007 and hip pads 1009 (only one visible). Also shown attached to the vertical section are a lumbar pad 1014 and a thoracic pad 1015. One of optional shoulder pads 1043 is shown coupled to a shoulder element 1001. The curved portion 1002 of the shoulder section that fits over the user's shoulders is also shown. Optional supports 1031 and strap 1032 are also shown.

Figure 11:
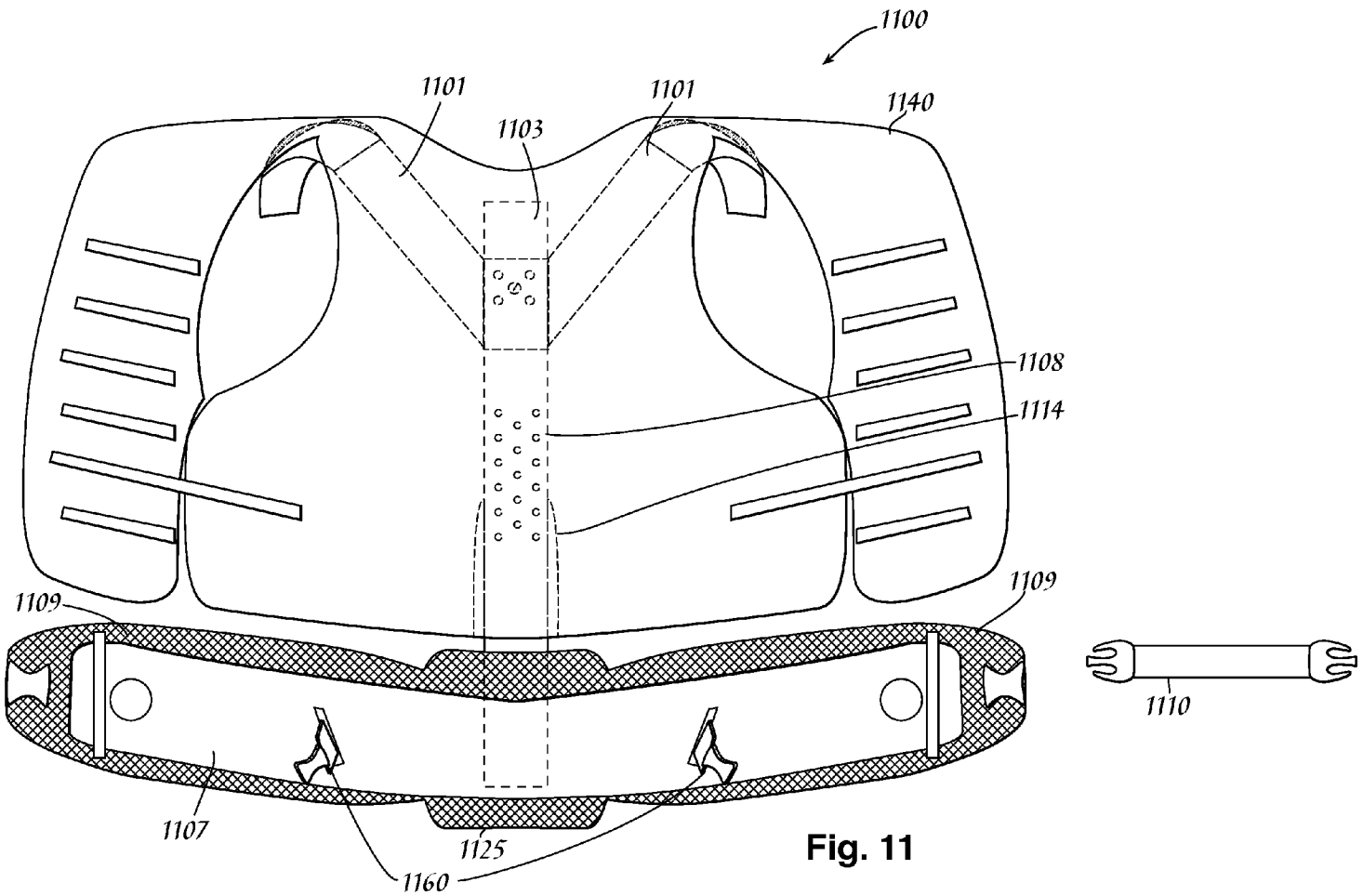
FIG. 11 is a back view of a body support system with overlaying body armor according to an embodiment with the hip section unlatched.

FIG. 11 is a back view of a body support system 1100 with overlaying body armor 1140 according to an embodiment. Shoulder elements 1101 are joined with base 1103 and is adjustably positioned along vertical section 1108. Portions of a lumbar pad are shown behind body armor 1140. Also shown in this view are the hip section elements 1107 with portions of hip pads 1109 and lumbar pad 1125. Optional stabilizing attachments 1160 and hip section strap 1110 are also shown.

Figure 12A:
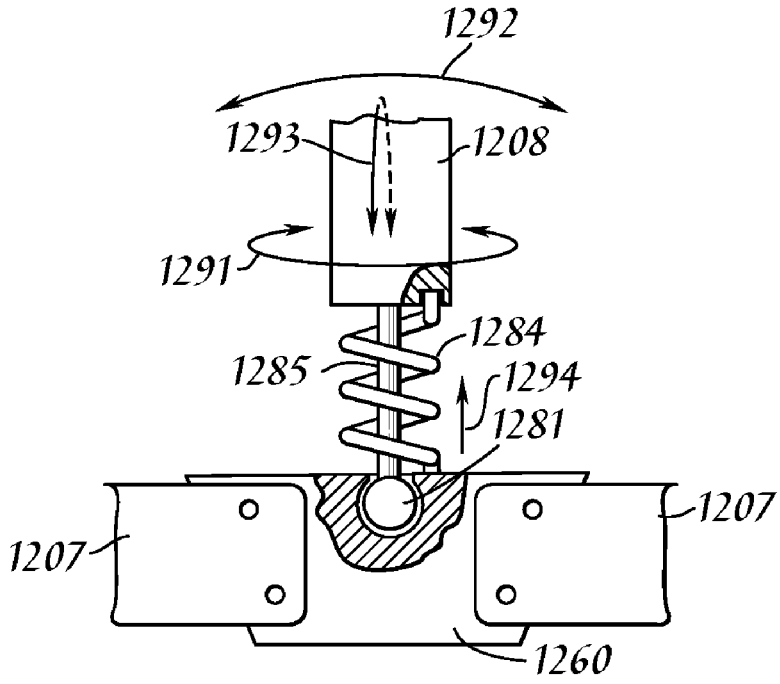
FIG. 12A illustrates a flexible connection of the vertical section to the hip section that provides rigidity in the vertical axis according to an embodiment.

FIG. 12A is a view of the attachment between a vertical section 1208 and a hip section comprising hip elements 1207 joined to a base section 1260 and suitable for body support systems according to embodiments herein. A shaft 1285 is fixed to vertical section 1208 and coupled with a ball joint 1281 to base section 1260. A coil spring 1284 is fixed to both vertical section 1208 and base section 1260. This attachment of vertical section 1208 to the hip section allows a user to have several degrees of freedom to bend 1293, twist 1291, and rotate 1292 their upper body while maintaining stiffness in the vertical axis 1294 of vertical section 1208. Coil spring 1284 may be configured to allow some cushioning of shock directed in the vertical axis along vertical section 1208.

Figure 12B:
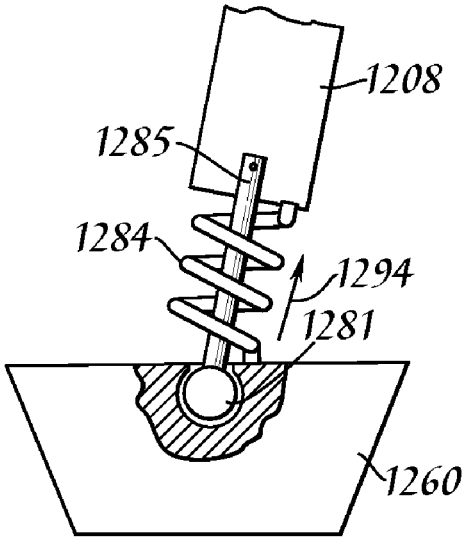
FIG. 12B illustrates a flexible connection of the vertical section to the hip section of FIG. 12A showing pivoting about an axis orthogonal to the vertical axis.

FIG. 12B is a front view of the attachment of FIG. 12A showing vertical section 1208 coupled to base section 1260 with coil spring 1284 and shaft 1285. Also shown is a cross-section of ball joint 1281 with a socket in base section 1260.

Figure 13A:
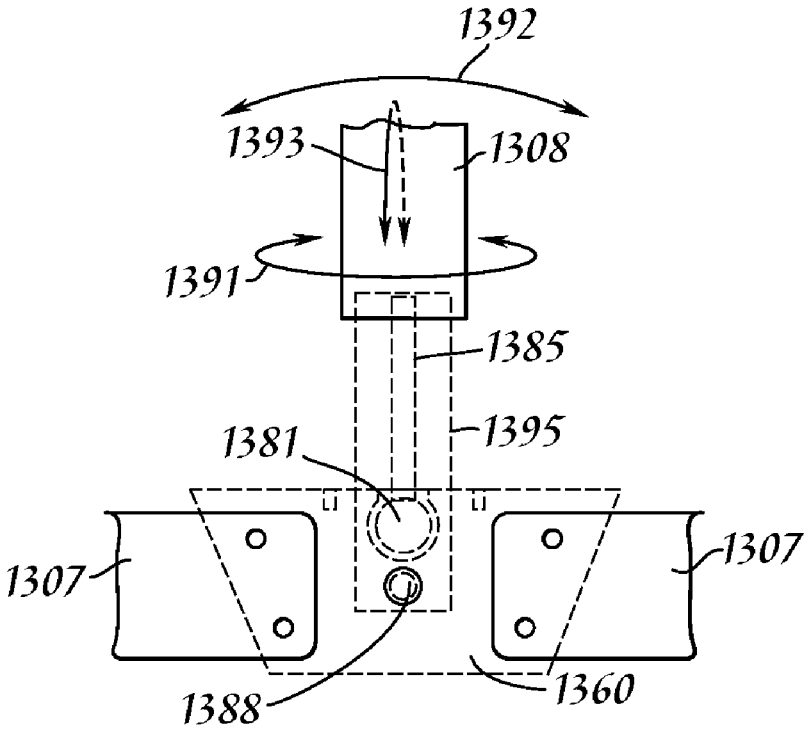
FIG. 13A illustrates a flexible connection of the vertical section to the hip section that provides rigidity in the vertical axis according to another embodiment.

FIG. 13A is a view of the attachment between a vertical section 1308 and a hip section comprising hip elements 1307 joined to a base section 1360 and suitable for use with body support systems according to embodiments herein. A shaft 1385 is fixed to vertical section 1308 and coupled with a ball joint 1381 to base section 1360. A leaf spring 1384 is fixed to vertical section 1308 and coupled with a pivot 1388 to base section 1360. This attachment of vertical section 1308 to the hip section allows a user to have several degrees of freedom to bend, twist and rotate their upper body while maintaining rigidity in the vertical axis of vertical section 1308.

Figure 13B:
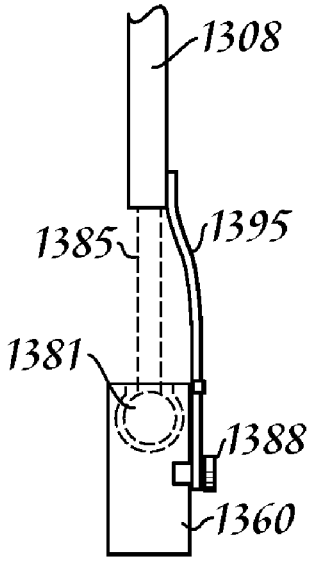
FIG. 13B is a side view of the attachment of the vertical section to the hip section according to an embodiment.

FIG. 13B is a side view of the attachment of FIG. 13A showing vertical section 1308 coupled to base section 1360 with leaf spring 1384 and shaft 1385. Also shown is a cross-section of ball joint 1381 with a socket in base section 1360.

A number of embodiments of the invention have been described. Nevertheless, it will be understood that various modifications may be made without departing from the spirit and scope of the invention.

What is claimed is:

1. A body support system comprising:

(a) a vertical section extending in a vertical axis between first and second ends, wherein the vertical section is configured to extend between the first and second ends substantially along a user's spine when the user is secured in the body support system;

(b) a shoulder section configured as a yoke with two shoulder elements joined at a base, wherein (i) each of the two shoulder elements is configured to ride above and off a shoulder of a user to reduce or prevent shoulder loading, (ii) the shoulder section is adjustably positionable along the vertical axis of the vertical section to conform to a size of the user, and (iii) the shoulder section is coupled to the vertical section proximate to the first end;

(c) a hip section with hip elements coupled to the vertical section at the second end, wherein (i) the hip elements are configured to flex to conform to hips of the user, and (ii) the hip section is rigidly coupled along the vertical axis and the hip section is flexibly coupled in other directions allowing the user a range of motions relative to the vertical axis when secured in the body support system; and (d) an adjustable latching strap configured to couple to connectors on the hip section and secure the hip elements around hips of a user when tightened.

2. The system of claim 1 further comprising hip padding configured as a lumbar pad coupled between first and second hip pads, wherein the hip padding is configured to couple to the hip section.

3. The system of claim 2, further comprising spinal padding coupled to the vertical section and configured as thoracic pad.

4. The system of claim 3, further comprising shoulder pads coupled to the shoulder elements of the shoulder section.

5. The system of claim 3, further comprising body armor in the form of a vest that is fitted over the body support system when worn by a user such that the weight of the body armor is directed by the frame through the vertical section and onto the hips of the user.

6. The system of claim 1, wherein each end of the shoulder elements has a mating feature for coupling load lifting straps configured to aid a user in lifting a load when secured in the body support system.

7. The system of claim 6, wherein the mating features are slots, wherein the load lifting straps are threaded through the slots and secured with suitable elements like buckles, snaps or mating hook and loop elements.

8. The system of claim 1, wherein the vertical section is curved in one plane to conform to contour of the back of a user.

9. The system of claim 1, wherein the vertical section has features that enable a back load to be attached to the vertical section thereby transferring back loading through the vertical section to the hip section and the hips and legs of a user.

10. The system of claim 1, wherein the adjustable latching strap is fitted with a latch that allows quick disconnect from a user when coupled to the back load.

11. The system of claim 1, wherein the vertical section is configured as a leaf spring structure that allows the vertical section to twist around the vertical axis and to flex when a user bends forward around his hips, the vertical section remaining rigid in compression and extension along the vertical axis of the vertical section.

12. The system of claim 1, wherein the vertical section is coupled to the hip section with a shaft fixed at the vertical section and coupled to the hip section with a ball joint and a coil spring structure concentric with the shaft, the coil spring structure having a first end coupled to the vertical section and a second end coupled to the hip section.

13. The system of claim 1, wherein the vertical section is coupled to the hip section with a pivot that allows stop limited rotation of the vertical section about an axis orthogonal to a vertical axis of the vertical section.

14. The system of claim 1, wherein the vertical section is coupled to a base of the hip section with a pivot that allows stop limited rotation of the vertical section about an axis orthogonal to the vertical axis of the vertical section and the hip elements are each coupled to the base with a pivot that allows stop limited rotation of the hip elements about the vertical axis.

15. The system of claim 1, further comprising an adapter coupled to the vertical section and configured to provide coupling for a variety of back loads including but not limited to back packs, back frames, bottled gas tanks, and baby carriers.

16. A body support system comprising:

(a) a vertical section extending in a vertical axis between first and second ends:

(b) a shoulder section configured as a yoke with two shoulder elements joined at a base configured to ride above and off a shoulder of a user to prevent shoulder loading, wherein the shoulder section is adjustably positioned along the vertical axis of the vertical section to conform to a size of the user and rigidly coupled to the vertical section proximate to the first end;

(c) a hip section with hip elements coupled at the second end, the hip elements configured to flex to conform to hips of the user, and the hip section is rigidly coupled along the vertical axis and flexibly coupled in other directions allowing the user a range of motions relative to the vertical axis when secured in the body support system, wherein the vertical section is coupled to the hip section with a shaft fixed at the vertical section and coupled to the hip section with a ball joint and a leaf spring substantially parallel with the shaft, the leaf spring having a first end coupled to the vertical section and a second end coupled to the hip section with a pivot allowing the vertical section to rotate around an axis orthogonal to the vertical axis of the vertical section; and (d) an adjustable latching strap configured to couple to connectors on the hip section and secure the hip elements around hips of a user when tightened.

17. A body support system comprising:

(a) a vertical section extending in a vertical axis between first and second ends, wherein the vertical section is configured to extend between the first and second ends substantially along a user's spine when the user is secured in the body support system;

(b) a shoulder section configured such that two shoulder elements extend from a base proximate to the first end of the vertical section, forming a 'Y' curving away from the base to conform to a user's shoulders, wherein (i) the two shoulder elements are configured to ride above and off the shoulders of the user to reduce or prevent shoulder loading, (ii) the shoulder section is adjustable such that it can be positioned along the vertical axis to conform to a size of the user, and (iii) the shoulder section is coupled to the vertical section proximate to the first end;

(c) a hip section with hip elements coupled to the vertical section at the second end, wherein (i) the hip elements are configured to disperse the load to hips of the user, and (ii) the hip section is coupled to the vertical section to allow motion orthogonal to the vertical axis in two axis and to allow motion rotationally about the vertical axis when the user is secured in the body support system; and (d) an adjustable latching strap configured to couple to connectors on the hip section and secure the hip elements around hips of a user when tightened.

* * * * *